US010978821B2

(12) United States Patent
Zhao et al.

(10) Patent No.: US 10,978,821 B2
(45) Date of Patent: Apr. 13, 2021

(54) ELECTRICAL CONNECTOR HAVING DEEP DRAWN SLEEVE WITH TWO PARTS OF DIFFERENT DIMENSIONS

(71) Applicants: FUYU ELECTRONICAL TECHNOLOGY (HUAIAN) CO.,LTD., Huai'an (CN); FOXCONN INTERCONNECT TECHNOLOGY LIMITED, Grand Cayman (KY)

(72) Inventors: Jun Zhao, Huaian (CN); Cai-Yun Zhang, Huaian (CN)

(73) Assignees: FUYU ELECTRONICAL TECHNOLOGY (HUAIAN) CO., LTD., Huai'an (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/663,376

(22) Filed: Oct. 25, 2019

(65) Prior Publication Data

US 2020/0136299 A1 Apr. 30, 2020

(30) Foreign Application Priority Data

Oct. 25, 2018 (CN) ..... 201821741284.X

(51) Int. Cl.

| | |
|---|---|
| ***H01R 9/05*** | (2006.01) |
| ***H01R 13/504*** | (2006.01) |
| ***H01R 13/405*** | (2006.01) |
| ***H01R 13/52*** | (2006.01) |

(52) U.S. Cl.

CPC ..... *H01R 13/504* (2013.01); *H01R 13/405* (2013.01); *H01R 13/5202* (2013.01)

(58) Field of Classification Search

CPC ..... H01R 13/504; H01R 13/405; H01R 13/5202; H01R 13/521; H01R 13/6595; H01R 13/6585; H01R 13/6581; H01R 2107/00; H01R 24/60

See application file for complete search history.

(56) References Cited

U.S. PATENT DOCUMENTS

| | | | | |
|---|---|---|---|---|
| 9,391,391 | B2 * | 7/2016 | Chien | H01R 13/5202 |
| 9,647,369 | B2 * | 5/2017 | Tsai | H01R 24/62 |
| 9,647,377 | B1 * | 5/2017 | Peng | H01R 13/405 |
| 9,742,098 | B2 * | 8/2017 | Zhao | H01R 13/6581 |

(Continued)

FOREIGN PATENT DOCUMENTS

| | | |
|---|---|---|
| CN | 107069309 A | 8/2017 |
| CN | 108365398 A | 8/2018 |
| CN | 108418039 A | 8/2018 |

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical connector includes: an insulative housing having a rear base and a front tongue with two opposite surfaces, plural contacts secured to the insulative housing and exposed to the two opposite surfaces of the tongue, and a deep drawn sleeve having a front part of a first transverse dimension and a rear part of a second transverse dimension less than the first transverse dimension, wherein the rear part of the sleeve is mounted to the base of the insulative housing and has a notch, and the base of the insulative housing has a restraining rib engaging the notch.

17 Claims, 16 Drawing Sheets

(56) References Cited

U.S. PATENT DOCUMENTS

| | | | | |
|---|---|---|---|---|
| 10,276,982 | B2 * | 4/2019 | Feng | H01R 13/6596 |
| 10,454,206 | B2 * | 10/2019 | Zhao | H01R 43/24 |
| 2016/0104957 | A1 * | 4/2016 | Kim | H01R 13/5219 439/78 |
| 2016/0141792 | A1 * | 5/2016 | Zhao | H01R 12/724 439/78 |
| 2016/0352041 | A1 * | 12/2016 | Yao | H01R 43/0256 |
| 2017/0047687 | A1 * | 2/2017 | Yao | H01R 12/724 |
| 2017/0264054 | A1 * | 9/2017 | Zhao | H01R 13/6593 |
| 2017/0338585 | A1 | 11/2017 | Foxconn | |
| 2018/0366862 | A1 | 12/2018 | Foxconn | |
| 2019/0312385 | A1 * | 10/2019 | Shain | H04N 5/232 |
| 2019/0379165 | A1 * | 12/2019 | Zhu | H01R 12/52 |
| 2020/0136291 | A1 * | 4/2020 | Zhao | H01R 43/16 |

* cited by examiner

ELECTRICAL CONNECTOR HAVING DEEP DRAWN SLEEVE WITH TWO PARTS OF DIFFERENT DIMENSIONS

BACKGROUND OF THE INVENTION

1. Field of the Invention

The present invention relates to an electrical connector including an insulative housing, a plurality of contacts secured to the insulative housing, and a deep drawn sleeve having a front part of a first transverse dimension and a rear part of a second transverse dimension less than the first transverse dimension, wherein the rear part of the sleeve is specially designed to firmly connected to the base of the insulative housing.

2. Description of Related Arts

China Patent No. 108365398 discloses an electrical connector including an insulative housing and a deep drawn sleeve mounted to the insulative housing by way of an interconnecting piece. The sleeve is of a stepped structure so that a rear part thereof has a reduced outer dimension to save space.

SUMMARY OF THE INVENTION

An electrical connector comprises: an insulative housing having a rear base and a front tongue with two opposite surfaces; a plurality of contacts secured to the insulative housing and exposed to the two opposite surfaces of the tongue; and a deep drawn sleeve having a front part of a first transverse dimension and a rear part of a second transverse dimension less than the first transverse dimension; wherein the rear part of the sleeve is mounted to the base of the insulative housing and has a notch, and the base of the insulative housing has a restraining rib engaging the notch.

DETAILED DESCRIPTION OF THE PREFERRED EMBODIMENT

Figure 1:
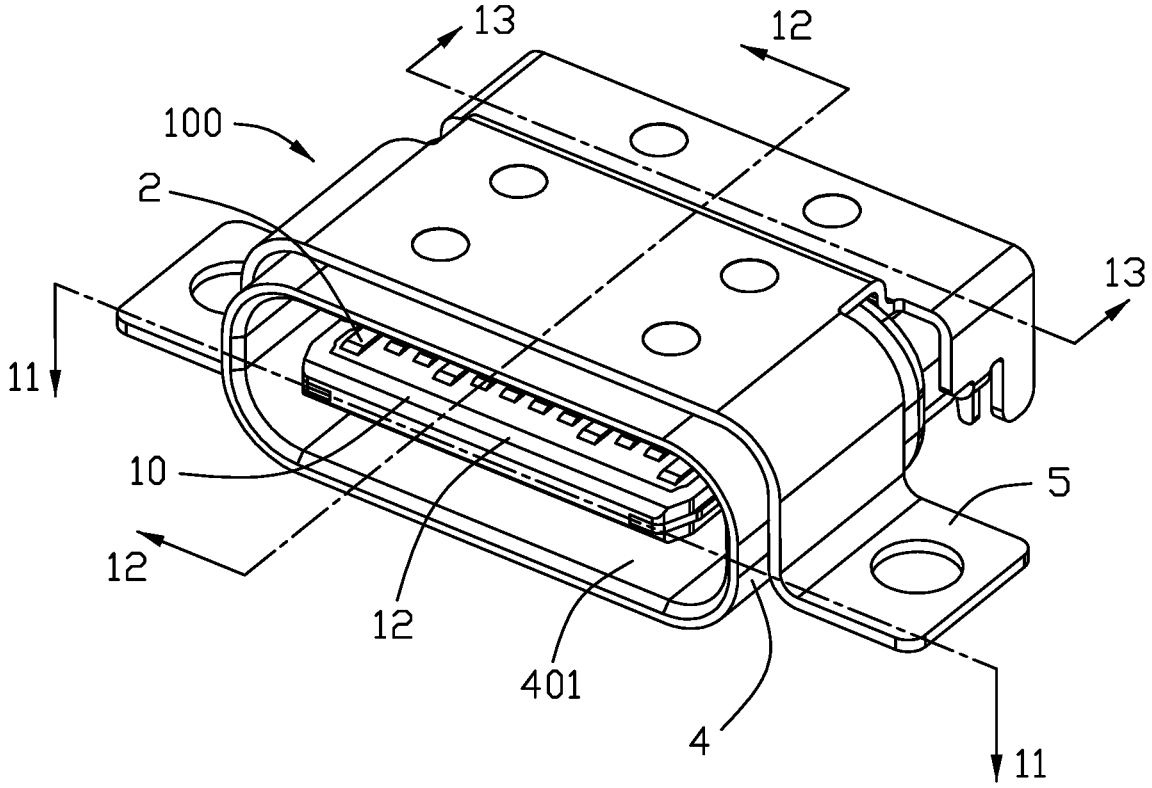
FIG. 1 is a top perspective view of an electrical connector in accordance with the present invention.
Figure 2:
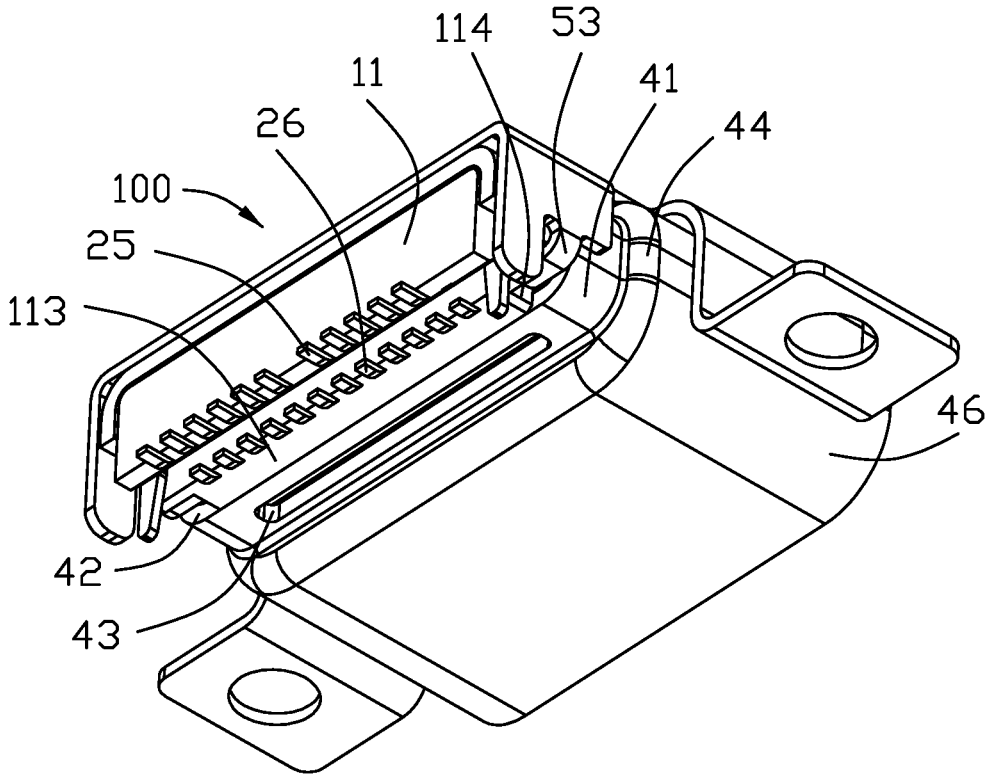
FIG. 2 is a bottom perspective view of the electrical connector.
Figure 3:
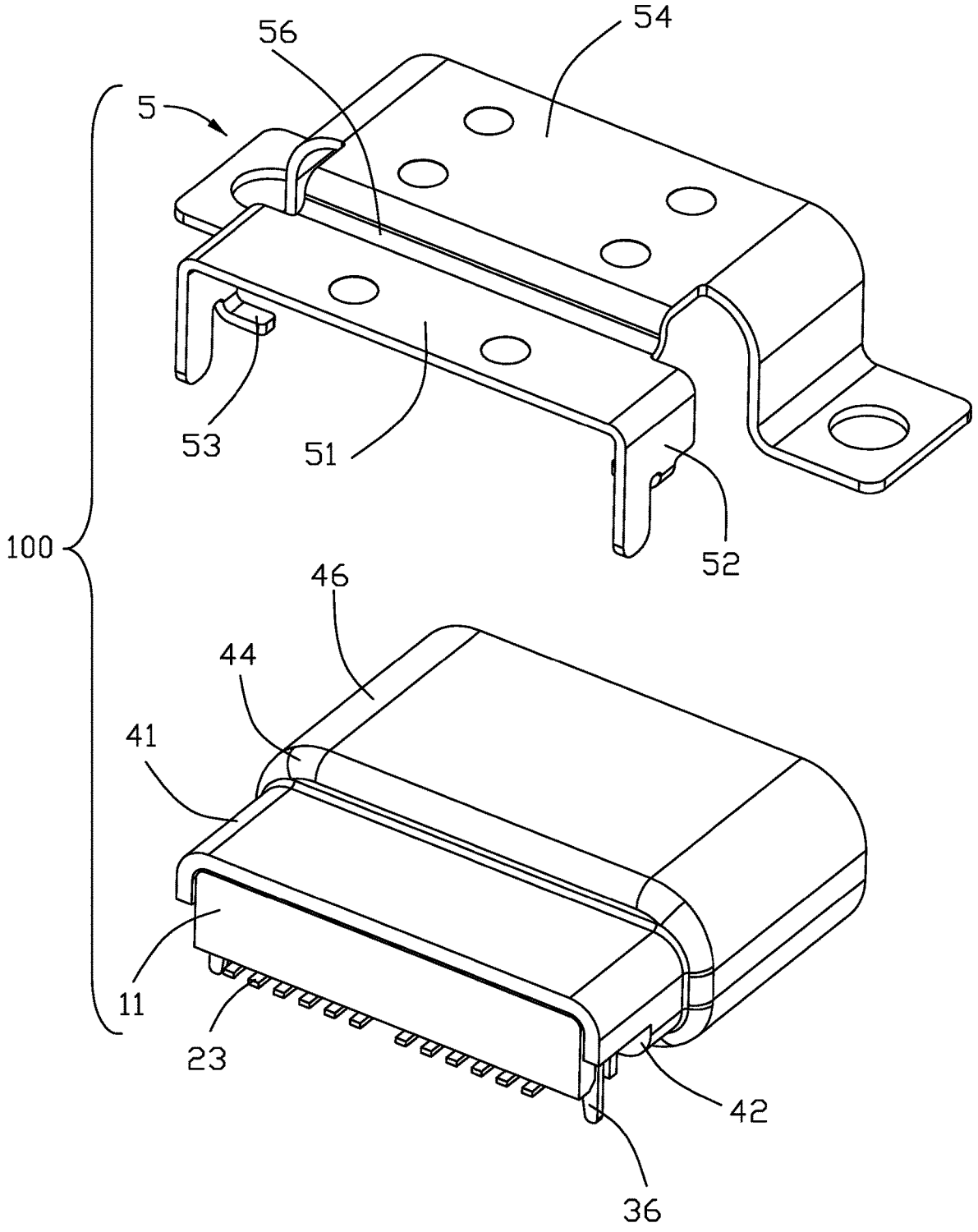
FIG. 3 is an exploded view of the electrical connector.
Figure 4:
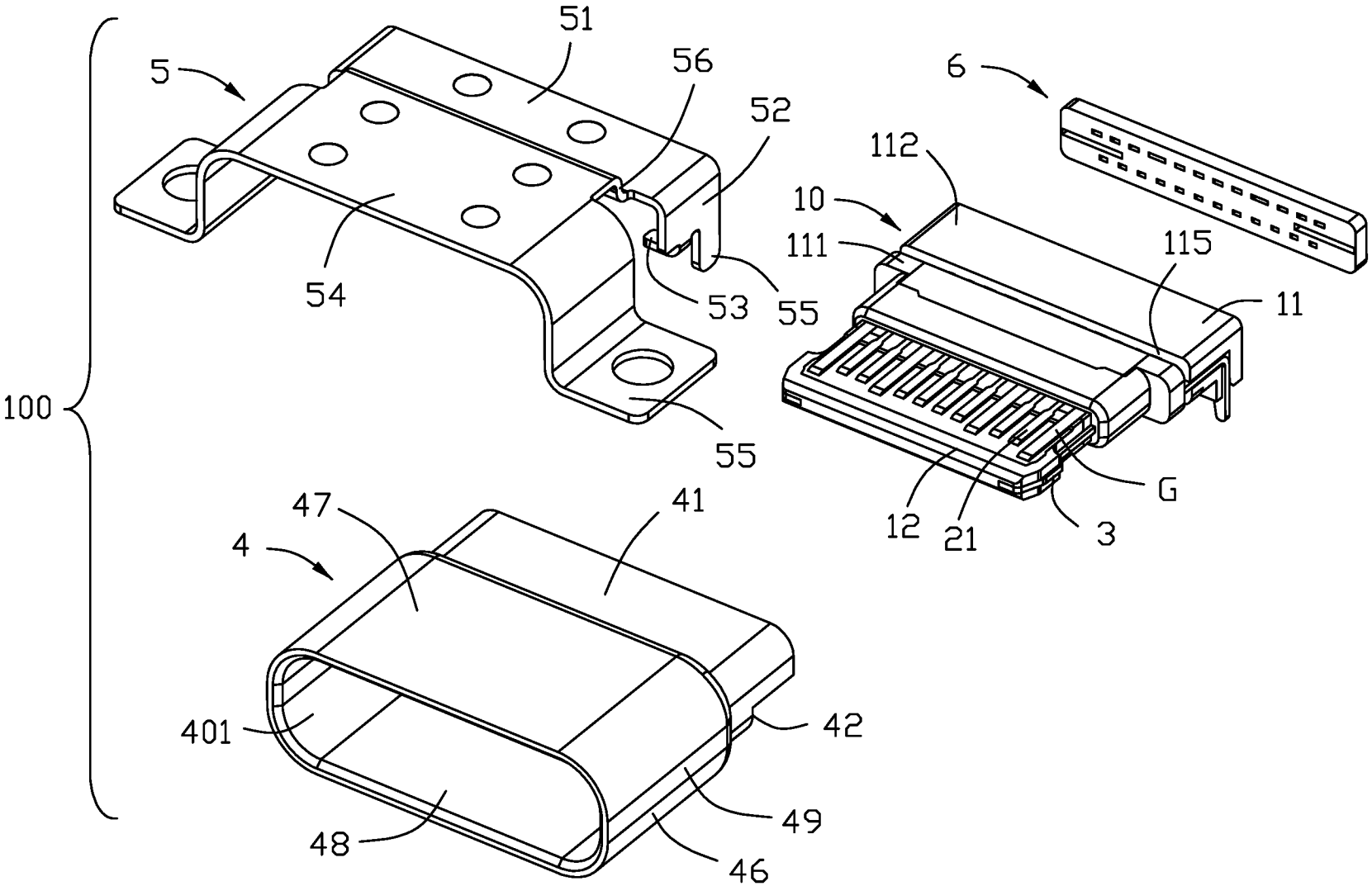
FIG. 4 is a further exploded view of the electrical connector in FIG. 1.
Figure 5:
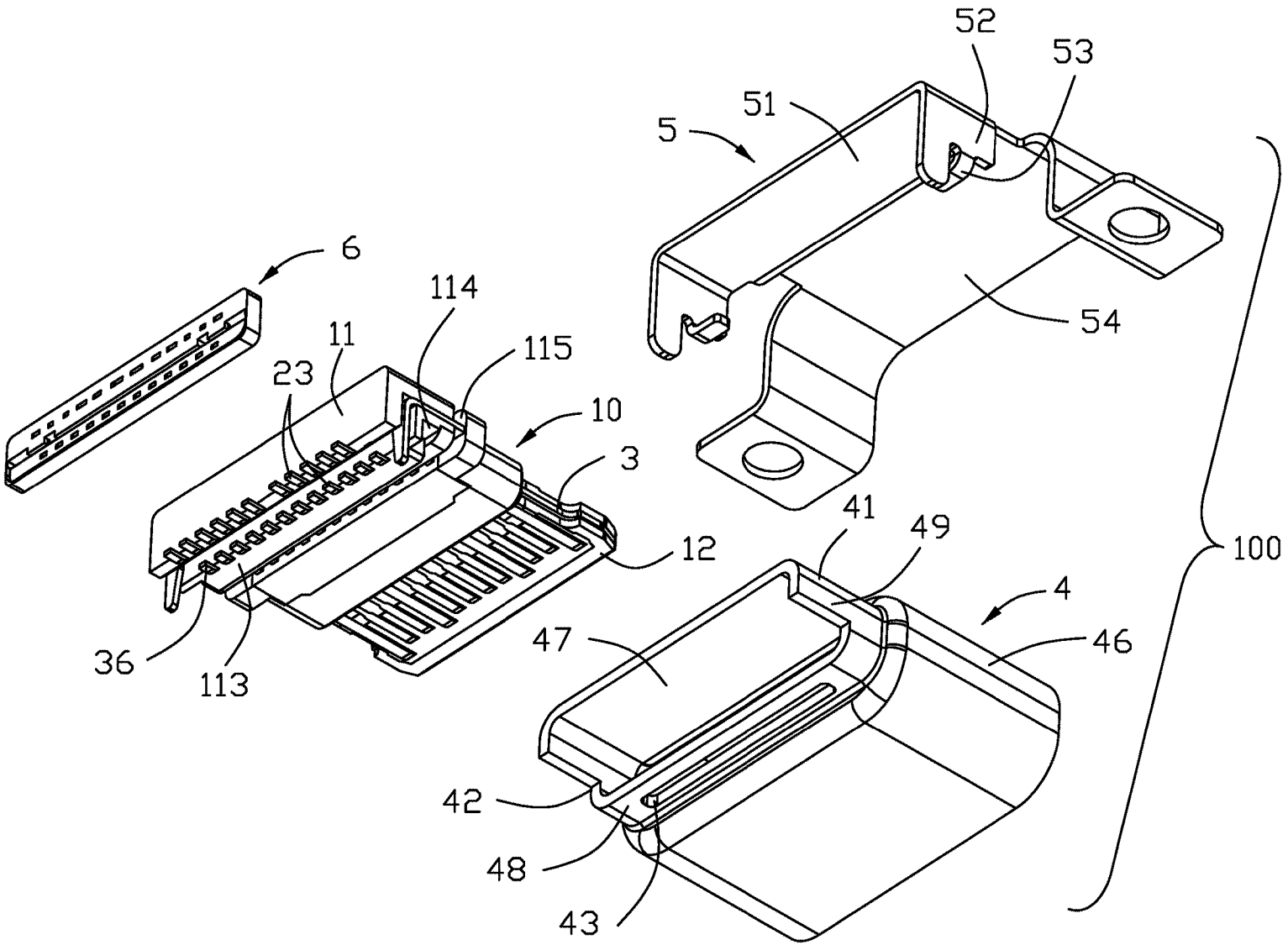
FIG. 5 is a further exploded view of the electrical connector in FIG. 2.
Figure 6:
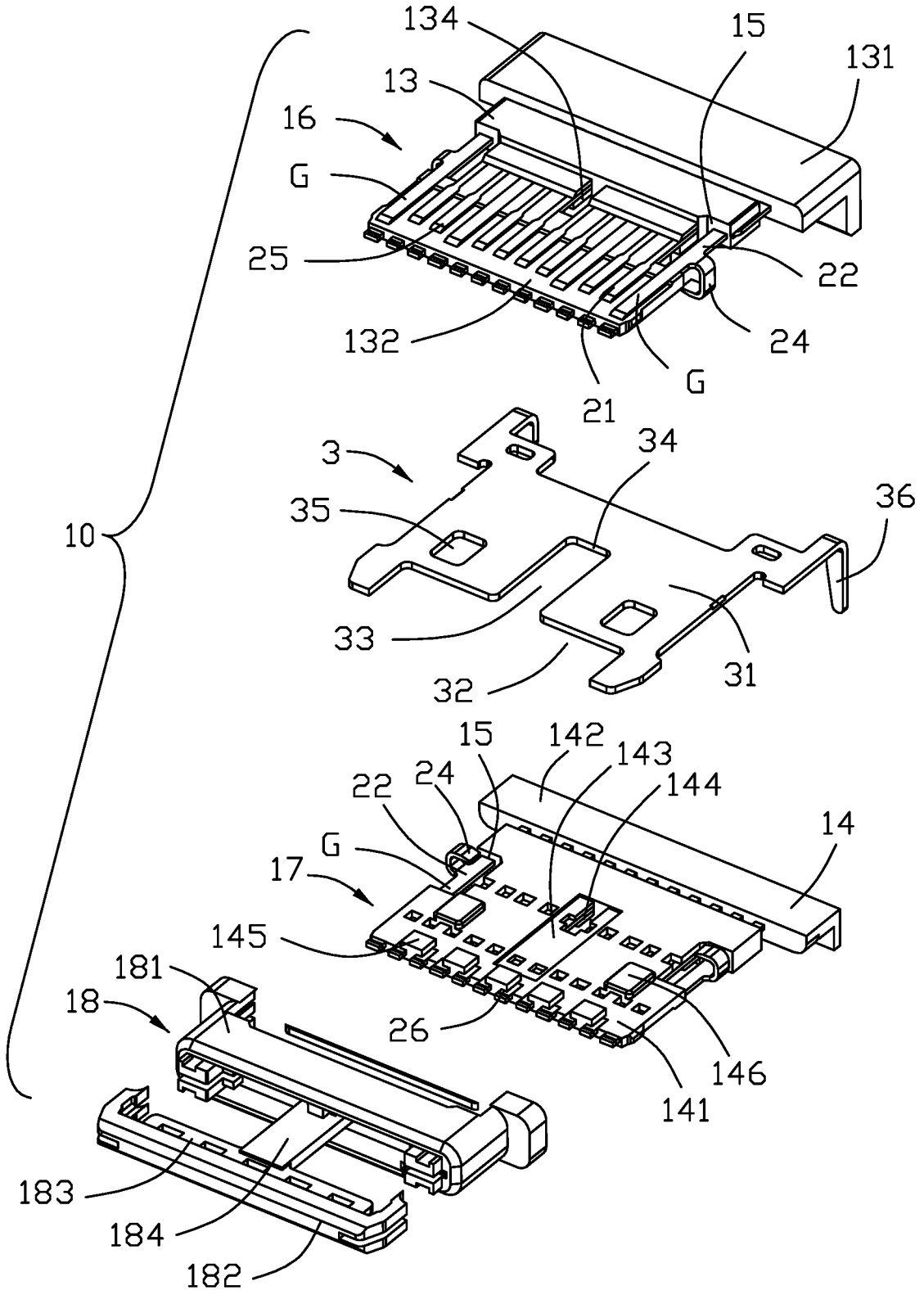
FIG. 6 is an exploded view of a contact module of the electrical connector.
Figure 7:
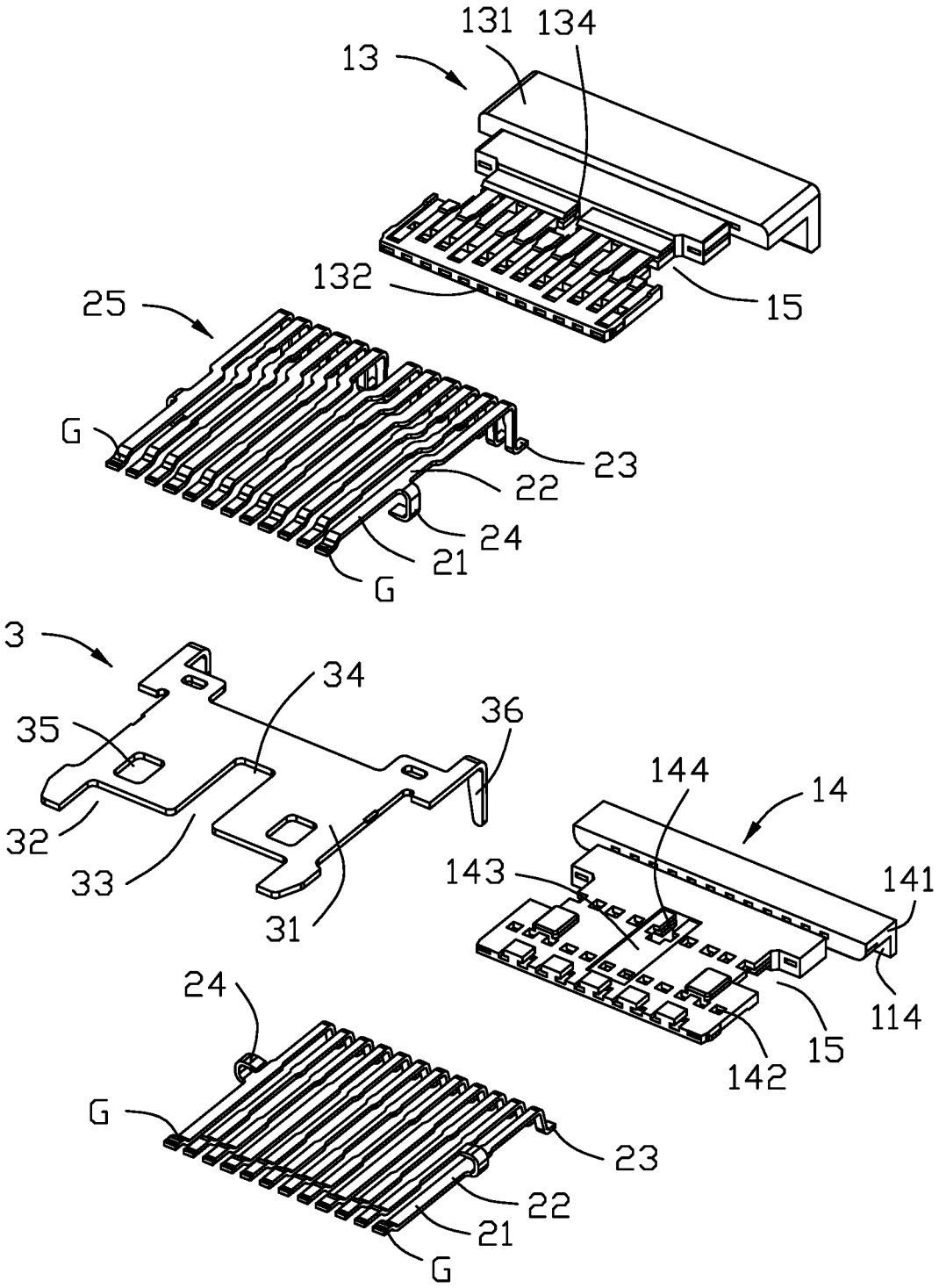
FIG. 7 is a further exploded view of the contact module in FIG. 6.
Figure 8:
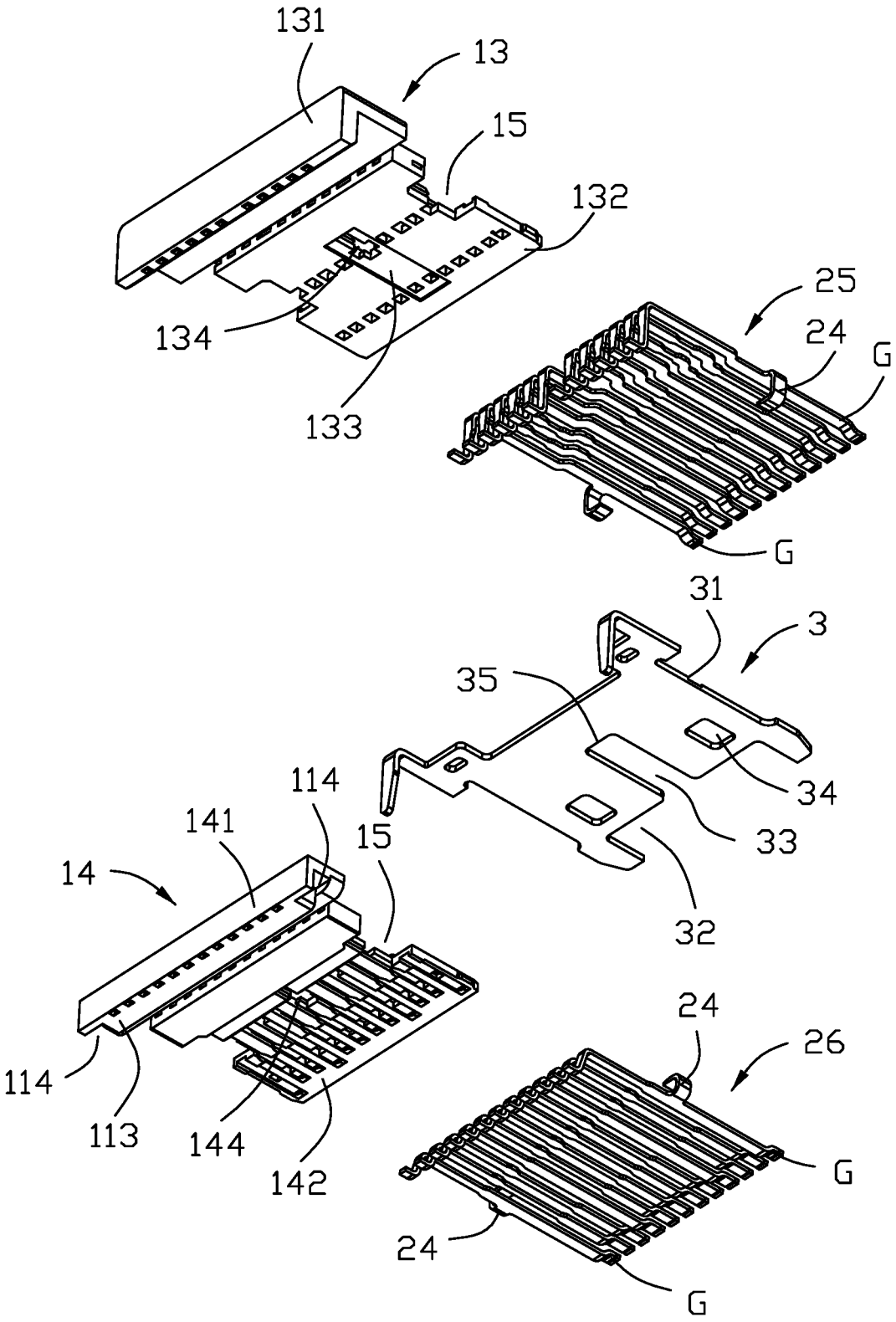
FIG. 8 is a view similar to FIG. 7 but from another perspective.
Figure 9:
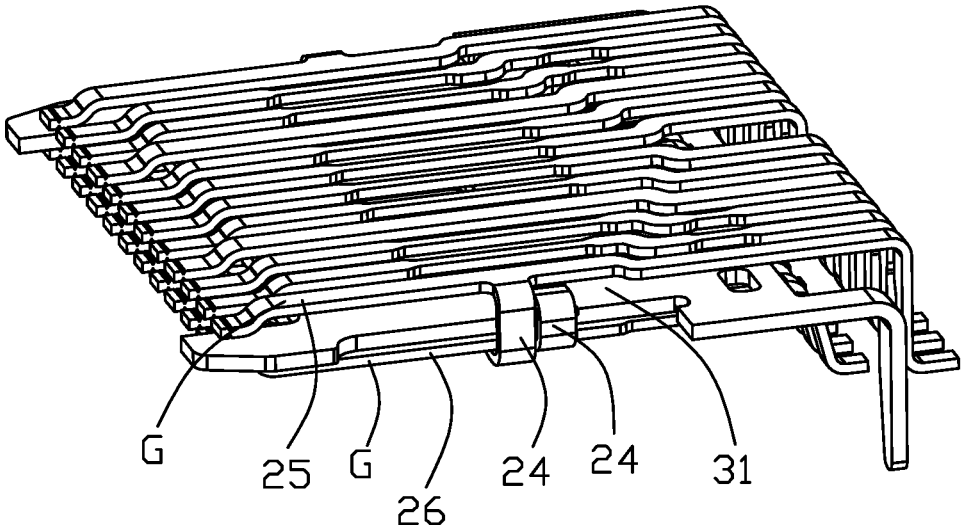
FIG. 9 schematically shows an upper and lower rows of contacts and a middle shielding plate of the contact module.
Figure 10:
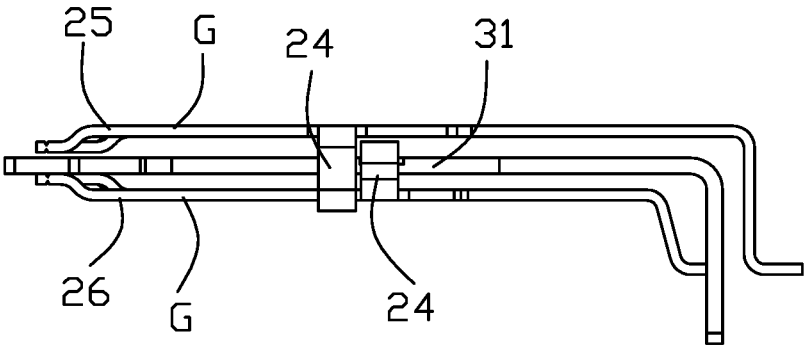
FIG. 10 is a side view of FIG. 9.
Figure 11:
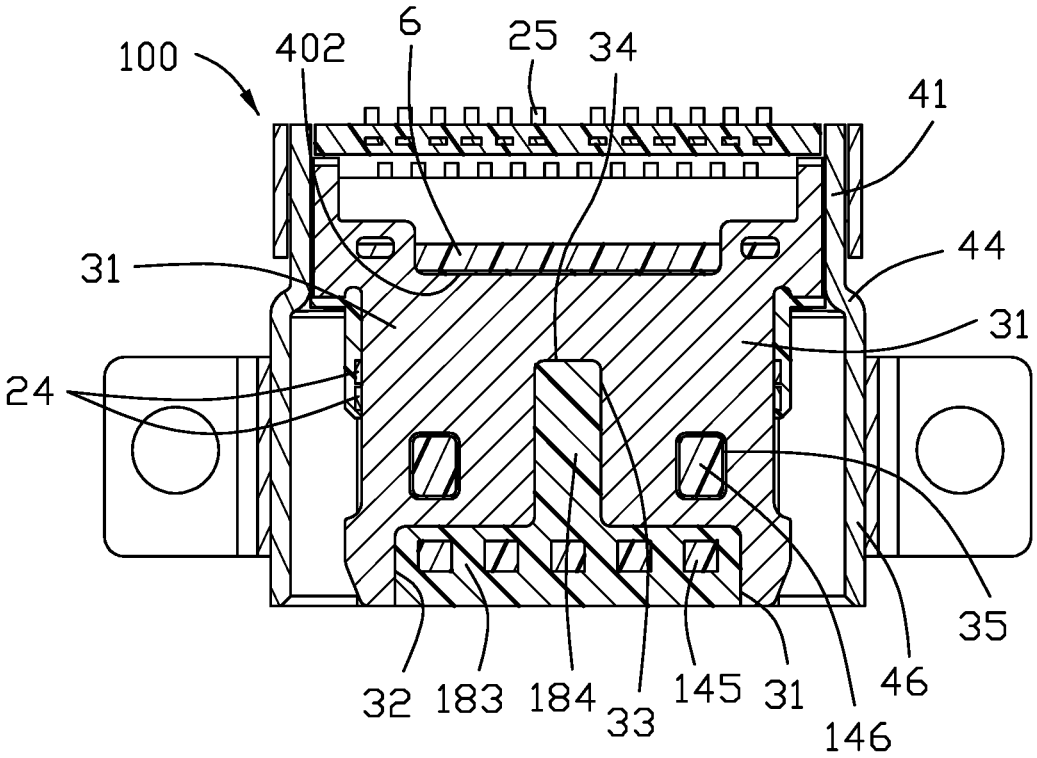
FIG. 11 is a cross-sectional view of the electrical connector taken along line 11-11 in FIG. 1.
Figure 12:
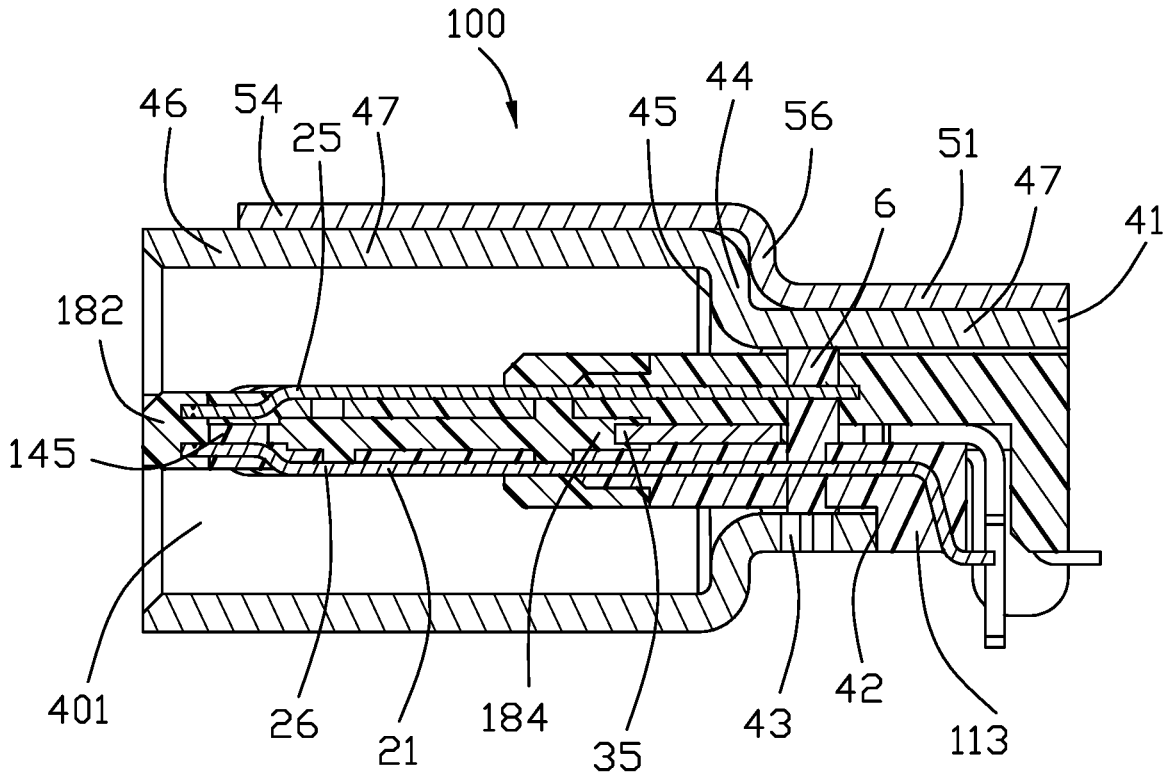
FIG. 12 is a cross-sectional view of the electrical connector taken along line 12-12 in FIG. 1.
Figure 13:
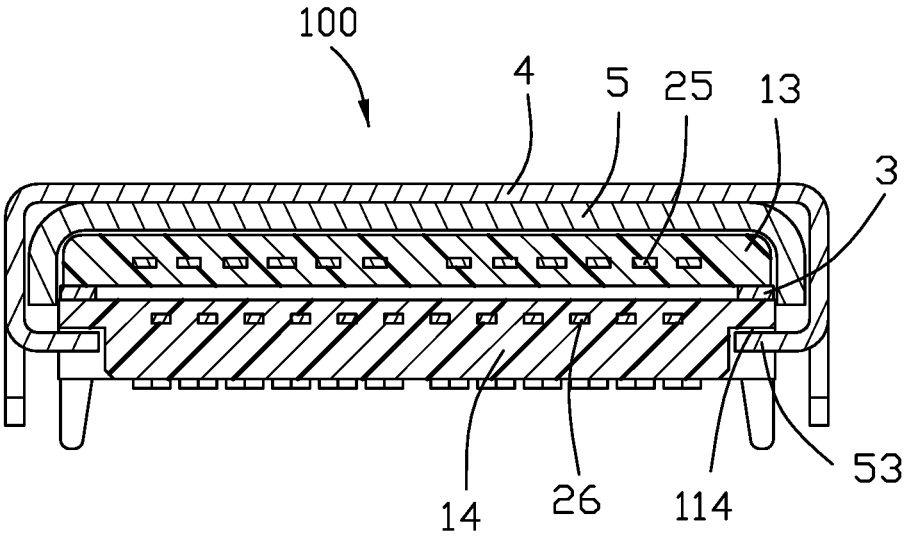
FIG. 13 is a cross-sectional view of the electrical connector of FIG. 1.

Referring to FIGS. 1-13, an electrical connector 100 in accordance with the present invention comprises a contact module 10 and a metallic sleeve 4 made by a deep drawing process. The electrical connector 100 may further comprise an outer metallic cover 5 and a sealing member 6. The contact module 10 includes an insulative housing 1 and a plurality of contacts 2 secured to the insulative housing 1. The contact module 10 may further include a middle shielding plate 3.

The insulative housing 1 has a base 11 and a front tongue 12. The base 11 has a front portion 111 and a rear portion 112 with a gap 115 therebetween. The rear portion 112 has a lower restraining rib 113. Formed at both sides of the rib 113 are two positioning grooves 114. The insulative housing 1 is consisted of an upper insulator 13, a lower insulator 14, and an over-mold 18. The upper insulator 13 has a base portion 131 and a tongue portion 132. The upper insulator 13 has an elongate recess 133 at a bottom thereof. The base portion 131 has a hole 134 in fluid communication with the recess 133. A pair of side notches 15 are formed at two sides of the base portion 131. The lower insulator 14 has a base portion 141 and a tongue portion 142. The lower insulator 14 has a recess 143 at a top thereof. The tongue portion 142 has plural protrusions 145 and 146. A pair of side notches are also formed at two sides of the base portion 141. The over-mold 18 has a base portion 181 and a tongue portion 182. The tongue portion 182 has a front part 183 and a connecting part 184.

The contacts 2 are arranged in an upper row of contacts 25 secured to the upper insulator 13 and a lower row of contacts 26 secured to the lower insulator 14 and each contact has a securing portion 22, a front contacting portion 21 exposed to the tongue 12, and a rear soldering portion 23. Each row of contacts 25 or 26 include two outermost ground contacts G exposed to the side notches 15 and bent to form respective coupling portions 24.

The middle shielding plate 3 is disposed between the upper row of contacts 25 and the lower row of contacts 26. The shielding plate 3 has a main part 31 and a pair of soldering legs 36. The main part 31 has a first notch 32, a second notch 33, and a pair of holes 35.

The deep drawn sleeve 4 is a seamless piece and has a front part 46 of a first transverse dimension and a rear part 41 of a second transverse dimension less than the first transverse dimension. A transition 44 is formed between the front part 46 and the rear part 41. Therefore, the sleeve 4 is of a stepped structure. Each part 46 or 41 has a top wall 47, a bottom wall 48, and a pair of side walls 49. The rear part 41 of the sleeve 4 is mounted to the base 11 of the insulative housing 1 and has a notch 42 at a rear bottom thereof. A slot 43 is disposed at the bottom wall 48 of the rear part 41. The front part 46 encloses the tongue 12 to form a receiving space 401. The transition 44 has a generally flat abutting face 45 for contacting an inserted complementary connector in the receiving space 401 so as to protect the contact module 10 from potential damage.

The cover 5 may be spot-welded to the sleeve 4. The cover 5 has a rear part/section 51 abutting the top wall of the sleeve rear part 41, a front part/section 54 abutting the top wall of the sleeve front part 46, and a connecting part/section 56 abutting the transition 44 of the sleeve 4. The rear part 51 has a pair of side mounts 52 each having a leg 55. The front part 54 also has a pair of legs 55. A claw 53 is bent from each mount 52. The claws 53 engage the positioning grooves 114 to secure the rear part 41 of the sleeve 4 and the base 11 of the insulative housing 1 together for preventing relative movement therebetween.

To make the electrical connector 100 having the structural features described above, upper contact module unit 16 and lower contact module unit 17 are firstly formed and then all mentioned components above are assembled straightforwardly in a well known manner in this art. During formation of the sealing member 6, after the insulative housing 1 is forwardly inserted into the sleeve 4, the gap 115 between the front portion 111 and the rear portion 112 of the base 11 is surrounded by the sleeve rear part 41 to a confinement 402 which is then accessible through the slot 43 to thereby form the sealing member 6 to seal among the rear part 41 of the sleeve 4, the base 11 of the insulative housing 1, and the plurality of contacts 2 exposed in the gap 115.

Figure 14:
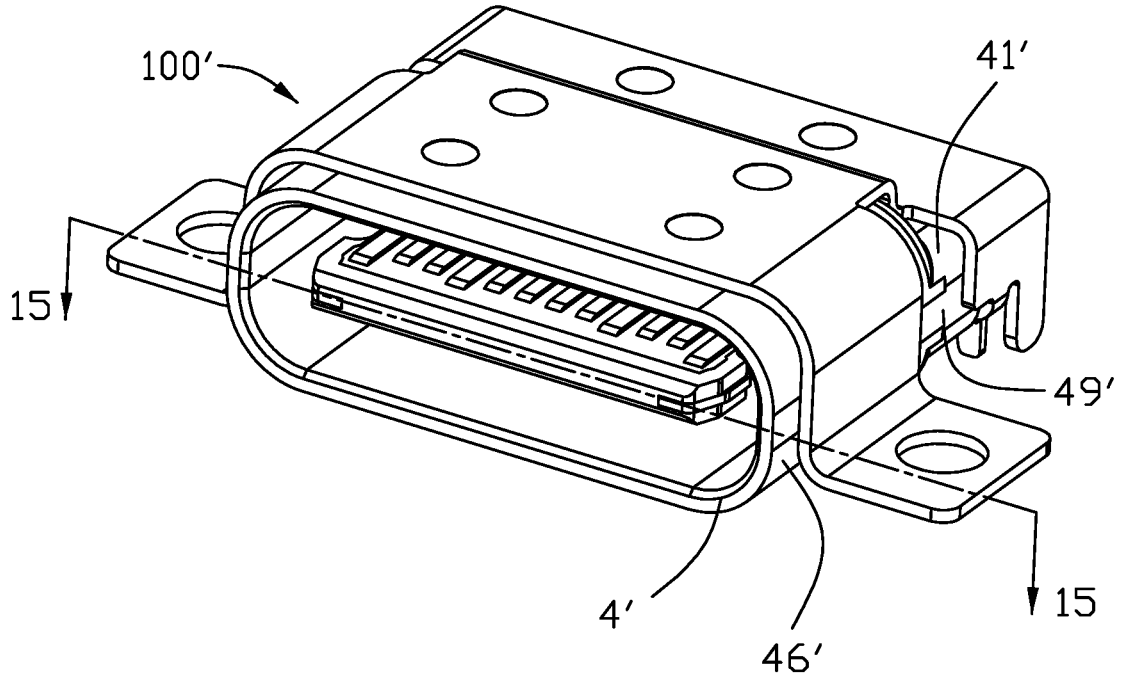
FIG. 14 is a front perspective view of a varied electrical connector in accordance with the present invention.
Figure 15:
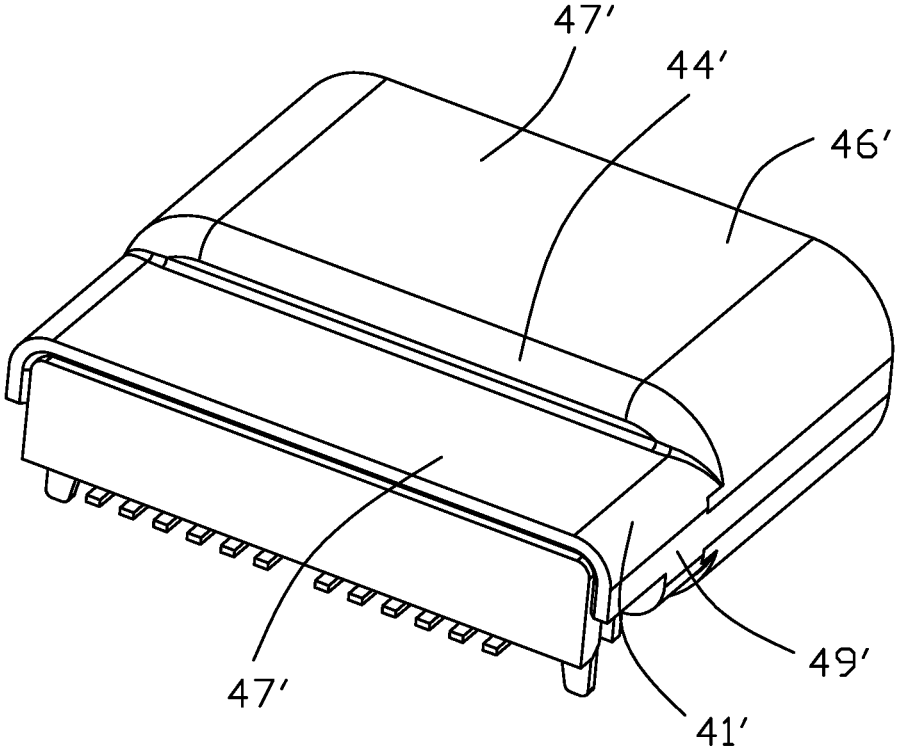
FIG. 15 is a rear perspective view of the varied electrical connector.
Figure 16:
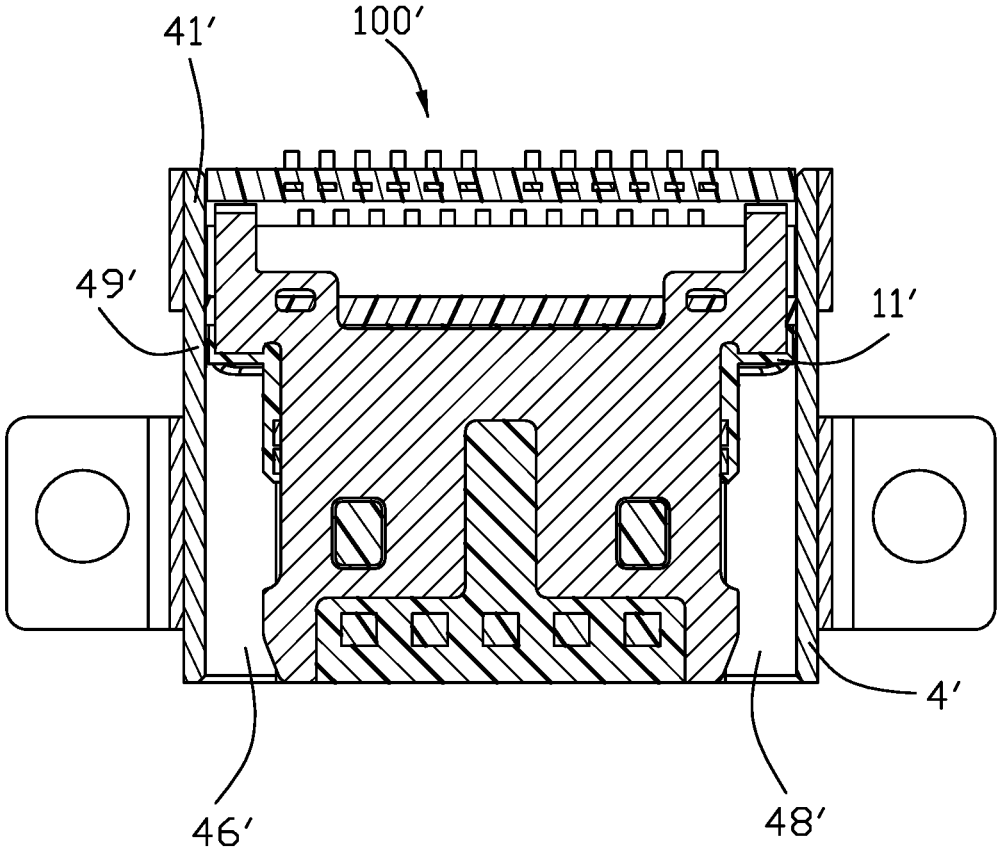
FIG. 16 is a cross-sectional view of the varied electrical connector taken along line 16-16 in FIG. 14.

Referring to FIGS. 14-16, in a varied electrical connector 100', a stepped sleeve 4' has a front part 46' and a rear part 41' with registered side walls 49'. As can be understood, a non-continuous transition 44' is interconnected between respective top walls 47' and respective bottom walls 48' of the two sleeve parts 46' and 41'.

One feature of the invention is to have the contact module 10 directly secured with regard to the cover 5 by engagement of the claws 53 within the corresponding positioning grooves 114 while the contact module 10 is not directly secured to the sleeve 4 but snugly received within the notch 42 with abutment between the contact module 10 and the sleeve 4 along the front-to-back direction and the transverse direction. In other words, the impact applied upon the sleeve 4 due to insertion of the plug connector, especially against the flat abutting face 45 of the transition 44 of the sleeve 4 along the front-to-back direction, and will not be significantly and directly applied upon the contact module 10, compared to the traditional sleeve without the transition thereof.

What is claimed is:

1. An electrical connector comprising:

an insulative housing having a rear base and a front tongue with two opposite surfaces;

a plurality of contacts secured to the insulative housing and exposed to the two opposite surfaces of the tongue; and a deep drawn sleeve having a front part of a first transverse dimension and a rear part of a second transverse dimension less than the first transverse dimension; wherein the rear part of the sleeve is mounted to the base of the insulative housing and has a notch, and the base of the insulative housing has a restraining rib engaging the notch; and a transition is formed between the front part and the rear part of the sleeve with a forward abutting face which is adapted to be abutted against by a complementary plug connector inserted into the front part of the sleeve.

2. The electrical connector as claimed in claim 1, further comprising a sealing member sealed among the rear part of the sleeve, the base of the insulative housing, and the plurality of contacts.

3. The electrical connector as claimed in claim 2, wherein the rear part of the sleeve has a slot for formation of the sealing member in place.

4. The electrical connector as claimed in claim 1, further comprising a metallic cover securing the base of the insulative housing to the rear part of the sleeve.

5. The electrical connector as claimed in claim 4, wherein the metallic cover is welded to the sleeve and has a pair of board-mounting legs.

6. An electrical connector comprising:

a contact module including an insulative housing and a plurality of contacts integrally formed within the housing, the housing including a front tongue and a rear base along a front-to-back direction;

a metallic seamless deep drawn sleeve receiving the contact module and including a front part defining a first cross-sectional dimension and a rear part defining a second cross-sectional dimension smaller than the first cross-sectional dimension in both a vertical direction and a lateral direction perpendicular to each other and commonly perpendicular to the front-to-back direction, a transition formed between the front part and the rear part along the front-to-back direction with a forward abutting face which is adapted to be abutted against by a complementary plug connector inserted into the front part of the sleeve; and a metallic cover secured upon the sleeve; wherein the base forms a pair of positioning grooves behind the rear part of the sleeve and exposed to an exterior, and the cover forms a pair of claws engaged with the corresponding positioning grooves for securement therebetween;

the rear part of the sleeve is mounted to the base of the insulative housing and has a notch, and the base of the insulative housing has a restraining rib received in the notch so as to abut against the sleeve at least in the front-to-back direction; and the base includes a front portion and a rear portion with a gap therebetween in the front-to-back direction, said gap being located in front of the notch and filled with a sealing member.

7. The electrical connector as claimed in claim 6, wherein said gap is located behind the transition in the front-to-back direction.

8. The electrical connector as claimed in claim 6, wherein in the base, an upper face of the front portion is coplanar with that of the rear portion while a lower face of the front portion is higher than that of the rear portion because of said restraining rib extending downwardly into the notch.

9. The electrical connector as claimed in claim 6, wherein the rear part of the sleeve forms a slot in alignment with the gap in the vertical direction for filling a sealing member into the gap from the exterior.

10. The electrical connector as claimed in claim 6, wherein the cover includes a front section intimately and compliantly positioned upon the front part of the sleeve, a rear section intimately and compliantly positioned upon the rear part of the sleeve, and a connecting part located between the front section and the rear section and intimately positioned upon the transition of the sleeve.

11. The electrical connector as claimed in claim 6, wherein the base is dimensioned larger than the tongue in the vertical direction.

12. The electrical connector as claimed in claim 6, wherein a thickness of the sleeve is larger than that of the cover.

13. The electrical connector as claimed in claim 6, wherein the sleeve forms a receiving space in front of the transition for receiving a plug connector therein, and the base forwardly extends into the receiving space with a distance being around one half of a length of the tongue in the front-to-back direction.

14. The electrical connector as claimed in claim 13, wherein the whole base keeps a flat upper face upwardly abutting against an interior upper surface of the sleeve.

15. An electrical connector comprising:

an insulative housing having a rear base and a front tongue with two opposite surfaces;

a plurality of contacts secured to the insulative housing and exposed to the two opposite surfaces of the tongue;

a deep drawn sleeve having a front part of a first transverse dimension and a rear part of a second transverse dimension less than the first transverse dimension; and a sealing member sealed among the rear part of the sleeve, the base of the insulative housing, and the plurality of contacts; wherein the rear part of the sleeve is mounted to the base of the insulative housing and has a notch, and the base of the insulative housing has a restraining rib engaging the notch; and the rear part of the sleeve has a slot for formation of the sealing member in place.

16. The electrical connector as claimed in claim 15, further comprising a metallic cover securing the base of the insulative housing to the rear part of the sleeve.

17. The electrical connector as claimed in claim 16, wherein the metallic cover is welded to the sleeve and has a pair of board-mounting legs.

* * * * *